United States Patent [19]

Bracewell

[11] 4,156,377

[45] May 29, 1979

[54] METAL WORKING MACHINE

[76] Inventor: Floyd V. Bracewell, P.O. Box 29035, Atlanta, Ga. 30329

[21] Appl. No.: 834,054

[22] Filed: Sep. 16, 1977

[51] Int. Cl.[2] ..... B26D 11/00; B26D 5/12

[52] U.S. Cl. ..... 83/524; 83/599; 83/618; 83/639

[58] Field of Search ..... 83/518, 519, 514, 515, 83/599, 618, 620, 622, 639, 524; 72/404

[56] References Cited

U.S. PATENT DOCUMENTS

| | | | |
|---|---|---|---|
| 3,140,634 | 7/1964 | McDaniel, Jr. | 83/639 X |
| 3,255,655 | 6/1966 | Stockard, Jr. | 83/639 X |
| 3,468,206 | 9/1969 | Bakula | 83/639 X |
| 3,701,276 | 10/1972 | Malmgren | 83/518 X |

*Primary Examiner*—J. M. Meister

*Attorney, Agent, or Firm*—Clarence A. O'Brien; Harvey B. Jacobson

[57] ABSTRACT

A single fluid power operated piston connected to a tool operating arm pivoted intermediate its opposite ends, undergoes movement through a predetermined stroke between limit positions to alternately perform punching and shearing operations at spaced stations along a common support bed of a metal working machine. The tool operating arm is held in one of its limit positions by the piston device under control of a selector valve while a foot pedal operated valve is displaced against a spring bias by the operator to effect powered displacement of the piston device to the other limit position in order to effect either a punching or shearing operation depending on the position of the selector valve. A shearing operation may also be performed through a second shear arm pivotally connected to the frame and actuated by the piston device.

10 Claims, 6 Drawing Figures

METAL WORKING MACHINE

BACKGROUND OF THE INVENTION

This invention relates to metal working machines of a type capable of performing different operations on metal workpieces including punching and shearing operations.

Metal working machines capable of performing different metal working operations on different types of workpieces, are well-known as disclosed for example in U.S. Pat. No. 3,701,276 to Malmgren, issued Oct. 31, 1972. Such multi-purpose machines while advantageous because of their versatility, have certain drawbacks, including for example increased cost of construction, more complex controls and more costly maintenance as compared to single-purpose metal working machines of comparable size and capacity. It is therefore an important object of the present invention to provide a multi-purpose machine which avoids the aforementioned drawbacks without sacrifice of the versatility associated with multi-purpose machines.

SUMMARY OF THE INVENTION

In accordance with the present invention, a multi-purpose, metal working machine is provided with a horizontal support bed along which spaced work stations are established for performing punching and shearing operations. These operations are performed alternately by tool assemblies that are operatively engaged by an upper tool operating arm pivoted on a fulcrum post. The tool operating arm is displaced through a predetermined stroke by a single fluid operated piston device. Each tool assembly aforementioned is actuated by the tool operating arm as it approaches its limit positions at the ends of its stroke. Thus, the tool operating arm is held in one of its limit positions by the piston device in preparation for a work operation, the limit position being selected through a selector valve operating on a fluid pressure supply system for the piston device. A foot pedal operated valve is displaced by the machine operator against a spring bias in order to perform a work operation by effecting supply of pressurized fluid to the piston device causing it to undergo powered movement in one direction. At the end of its power stroke, the force generated by the tool operating arm is limited by pressure relief valves which terminate the operating cycle and prevent occurrence of loud, high pressure bypass noise.

A third metal working operation such as shearing may be performed by means of a shear arm pivotally connected between the machine frame and the piston device. The shear arm is positioned below the upper tool operating arm and is operative on a workpiece anchored to a support surface below the common support bed aforementioned for the first two work operations. A hold-down device is provided for the lower work station which is positioned in vertical alignment below the upper shearing station on one side of the fulcrum post opposite the side on which the punching operation is performed.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
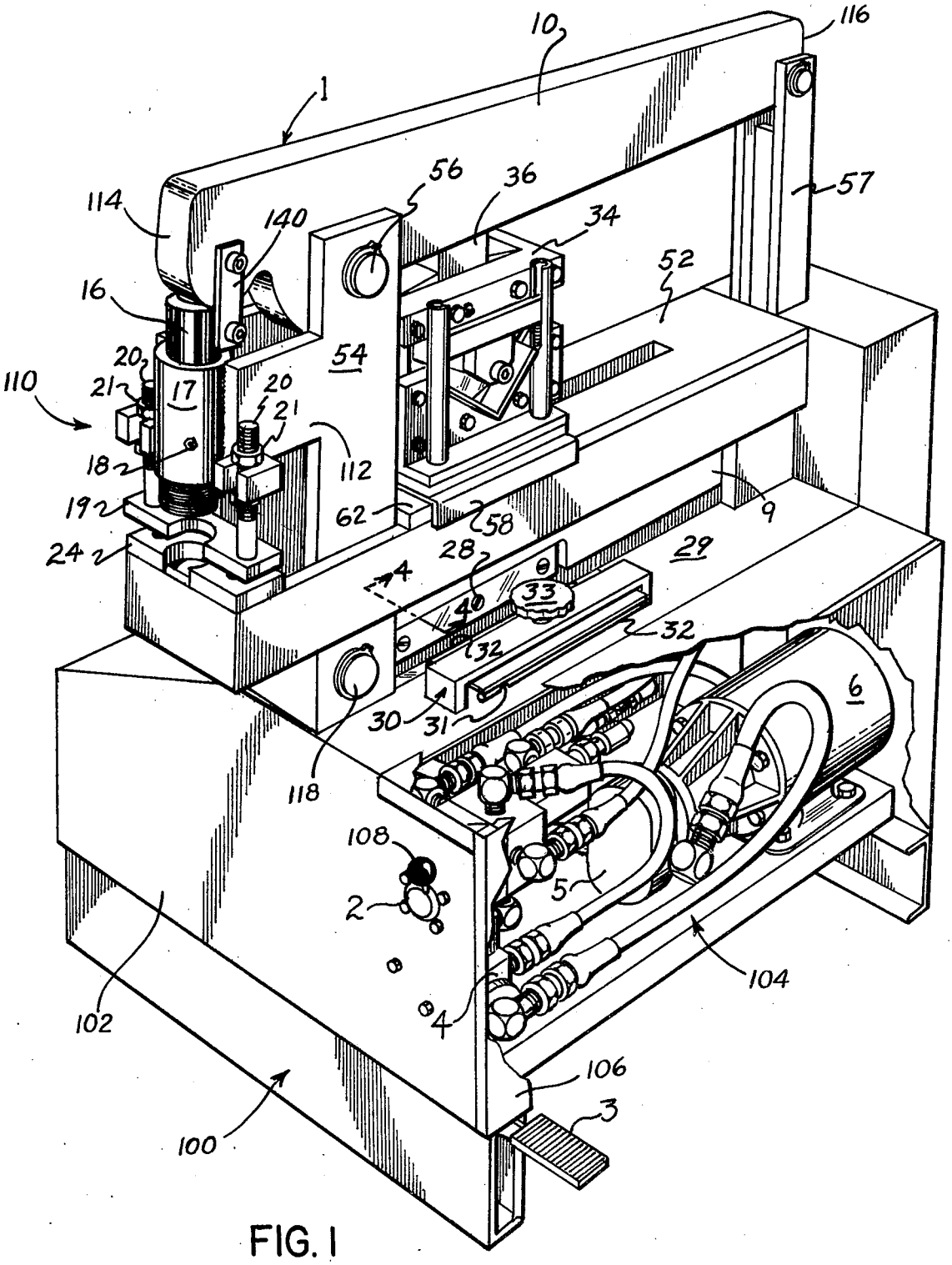
FIG. 1 is a perspective view of a metal working machine constructed in accordance with the present invention, with parts broken away to show portions of the fluid operating system.

Referring now to the drawings in detail, FIG. 1 illustrates a multi-purpose type of metal working machine generally referred to by reference numeral 1. The machine includes a fixed support base generally referred to by reference numeral 100 having a housing 102 enclosing a fluid power operating system generally referred to by reference numeral 104. The fluid power operating system is exposed within the housing upon removal of a front cover 106. A selector valve 2 is associated with the fluid power operating system and has a selector knob handle 108 exposed on one side of the machine. At the same side of the machine, a foot pedal control 3 is exposed for actuation by the machine operator as will be explained hereinafter. The machine housing 102 also presents on the top thereof, a support surface 29 on which a hold-down device 30 is located for releasably anchoring a workpiece for shearing operations as will be explained hereinafter. Projecting upwardly adjacent the same side of the machine as the selector valve 2 and foot pedal 3, is a vertical fulcrum post 54. The post extends through a horizontally elongated, support bed generally referred to by reference numeral 52. The support bed is vertically spaced above the work support surface 29 and has established thereon, spaced work stations on opposite sides of the fulcrum post 54 including a punching station established at one end by a die plate 24 secured thereto. A shearing station on the other side of the fulcrum post is established by means of an angle shearing tool assembly generally referred to by reference numeral 34. The shearing station established by the tool assembly 34 is spaced vertically above a shearing station on the surface 29 at which the hold-down device 30 is located. A punch tool assembly generally referred to by reference numeral 110 is supported by forward extensions 112 of the fulcrum post above the die plate 24.

The fulcrum post 54 is provided adjacent its upper end with a fulcrum pin 56 by means of which an upper tool operating arm 10 is pivoted intermediate its ends 114 and 116. A second fulcrum pin 118 is mounted by the post 54 just above the support surface 29 for pivotally mounting shear arm 9. The arms 10 and 9 are pivotally interconnected by a link arrangement 57 as more clearly seen in FIG. 2. The lower shear arm 9 is in turn pivotally connected by means of a clevis 13 to the upper end of a piston rod by means an adjustable nut 12, the piston rod extending upwardly from a fluid power piston cylinder 8 which is pivotally anchored at its lower end to the base 100 of the machine.

Figures 2, 3, 4, 5:
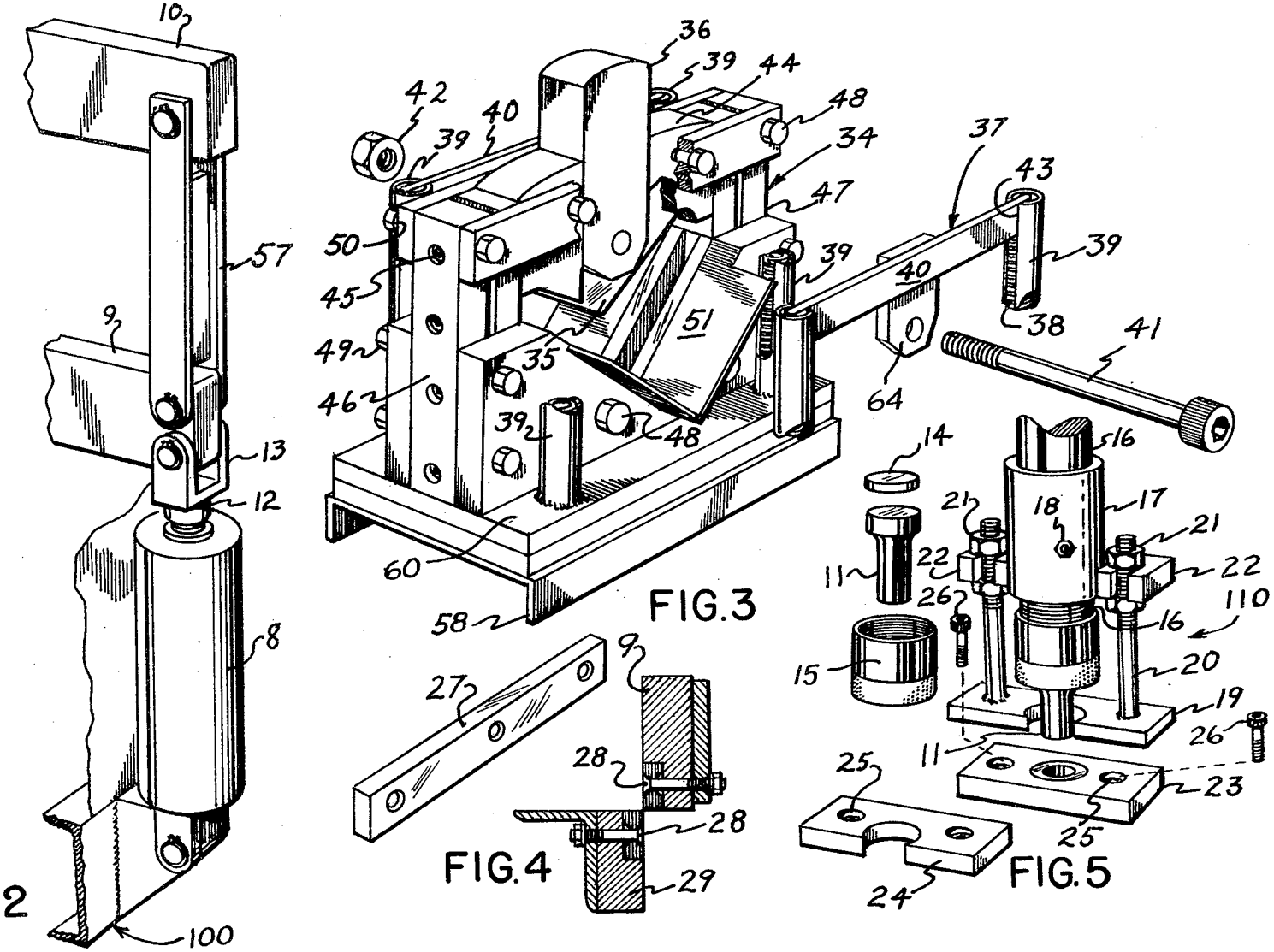
FIG. 2 is a partial perspective view showing the fluid power piston device.
FIG. 3 is a perspective view of certain disassembled portions of the tool assemblies associated with the metal working machine shown in FIG. 1, with parts broken away and shown in section.
FIG. 4 is an enlarged partial section view taken substantially through a plane indicated by section line 4—4 in FIG. 1.
FIG. 5 is a perspective view showing disassembled portions of the punch tool assembly associated with the metal working machine shown in FIG. 1.

Referring now to FIGS. 1 and 5 in particular, the punch tool assembly 110 includes a tubular housing 17 welded to the extensions 112 of the fulcrum post and thereby vertically positioned in axial alignment with the shearing station established by the die plate 24. A punch plunger 16 slidably extends through the tubular housing 17 and projects thereabove for engagement with the end 114 of the tool operating arm 10 to which the plunger is connected by means of the link 140. The punch plunger 16 may be lubricated through oil fittings 18 mounted on the housing 17. A pair of ears 22 extend laterally from the tubular housing 17 for supporting a pair of studs 20 by means of threaded nuts 21 to thereby adjustably position a stripper plate 19 connected as by welding to the lower ends of the studs. A punch tool element 11 extends through an opening in the stripper plate 19 and is mounted by means of a punch cap 15 adapted to be threadedly connected to the lower projecting end of the plunger 16 as shown in FIG. 5. A spacer insert 14 is received within the cap and is adapted to be disposed between the upper end of the punch tool element 11 and the plunger 16 in order to obtain the desired punch tool dimension. An alternate die plate 23 may be utilized in the punch tool assembly secured by means of fastener screw 26 extending through openings 25 into aligned openings in the lower die plate 24 secured by such fasteners to the support bed of the machine. It will therefore be apparent that a punching operation will be performed when the tool operating arm 10 is displaced in a counterclockwise direction as viewed in FIG. 1 corresponding to powered displacement of the piston device from a lower retracted position to an upper extended limit position.

In order to perform an angle shearing operation, the same tool operating arm 10 must be displaced from an upper limit position to a lower limit position as viewed in FIG. 1 causing downward displacement of a plunger 36 engaged with the underside of the tool operating arm 10 on the side of the fulcrum pin 56 opposite the punch tool plunger 16. As more clearly seen in FIG. 3, the plunger 36 associated with the shear tool device 34 is slidably displaceable through a blade guide 44 to project a blade element 35 between angle support cradles 51. Fastener bolts 48 and nuts 50 hold the blade guide 44 assembled between upper cross bars which bridge end blocks 46 and 47. Fasteners 45 extend from the end blocks into the blade guide 44 and are also secured by fasteners 49 to the laterally extending cradles 51 on which angle irons of different dimensions are positioned for a shearing operation. The blocks 46 and 47 and cradles 51 are secured to base plates 60, secured on top of a saddle 58 by means of which the shearing tool assembly 34 is positioned on the support bed 52. A spacer block 62 as shown in FIG. 1 spaces the shear tool assembly 34 from the fulcrum post 54.

With continued reference to FIGS. 1 and 3, the tool assembly 34 is provided with a spring return mechanism 37 which includes two pair of tubular elements 39 extending upwardly from the base plate 60 on opposite sides of the work cradles 51. The tubular elements have confronting slots slidably receiving the end portions of a pair of bridge elements 40 which are connected as by welding to downwardly depending lugs 64 secured by a fastener assembly 41–42 to the plunger 36. Springs 38 housed within the tubular elements 39 engage the bridge elements 40 to upwardly bias the plunger 36 in order to retract the shearing blade 35 after being displaced through a power stroke by the piston device during a shearing operation. As aforementioned, the shearing operation is performed by downward displacement of the piston from an upper retracted position in a direction opposite to the direction of the power stroke associated with the punch tool assembly 110.

A shearing operation may also be performed on a workpiece extended under the shear blade arm 9 and held anchored to the surface 29 by the hold-down device 30. As shown in FIG. 1, the hold-down device includes a movable bar 32 adapted to be vertically positioned by means of an adjustment knob 33, the bar having a notch 31 formed therein so as to enable positioning of rods therebelow. The work piece so anchored to the surface 29 will be sheared by blade elements 27 as shown in FIG. 4. The blade elements 27 are secured by fasteners 28 to the shear arm 9 and the work surface 29.

Figure 6:
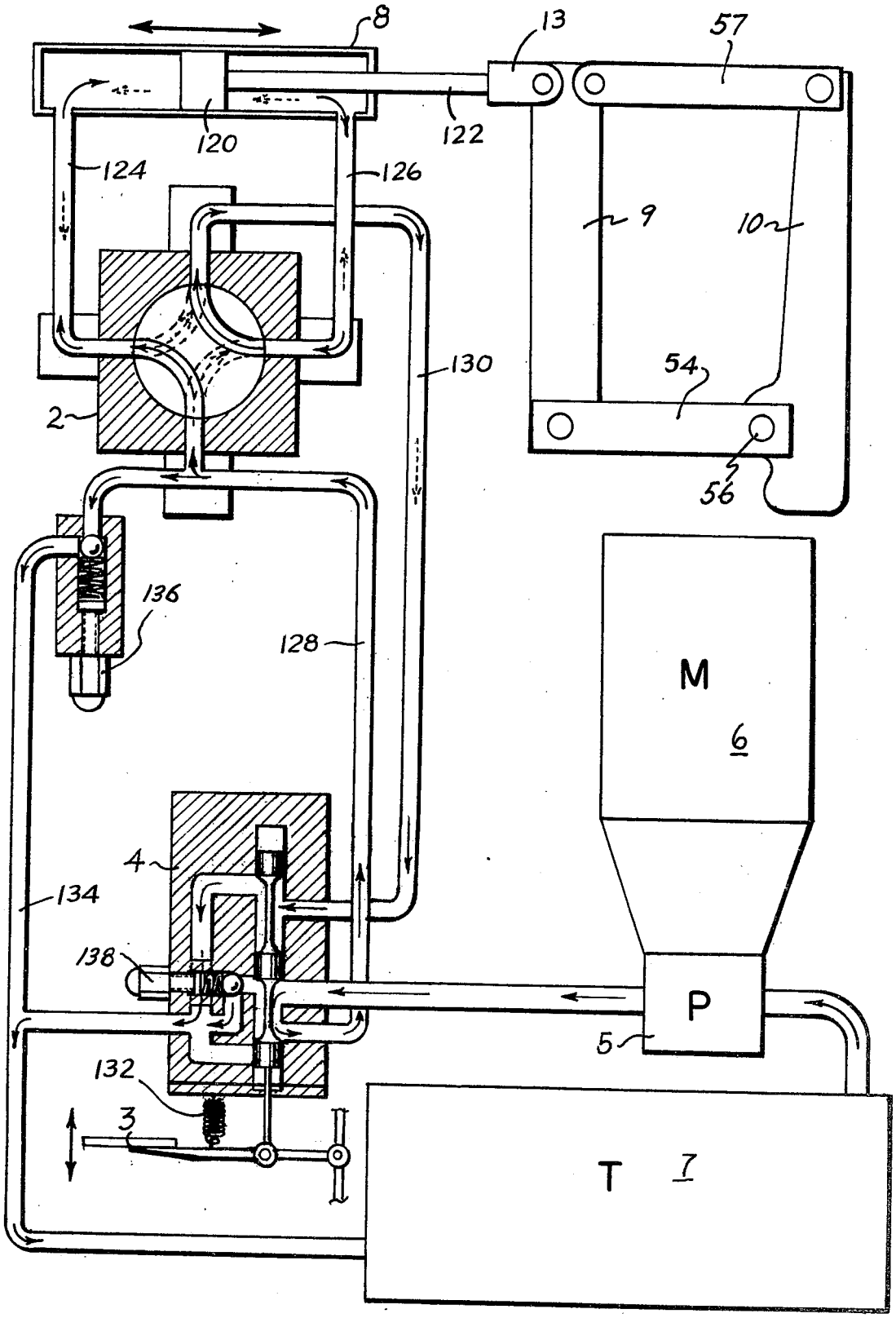
FIG. 6 is a simplified, somewhat diagrammatic illustration of the fluid power operating system associated with the metal working machine shown in FIG. 1.

The fluid power operating system 104 positioned within the housing 102 as shown in FIG. 1, is more clearly shown in FIG. 6. The selector valve 2 controls the supply of fluid under pressure to opposite sides of the piston 120 enclosed within the cylinder 8 from which the piston rod 122 extends. The fluid conduits 124 and 126 interconnecting the selector valve 2 with the cylinder 8 are therefore operative to alternately conduct or exhaust pressurized fluid to and from the cylinder. A pair of conduits 128 and 130, respectively, supply and exhaust pressurized fluid to and from the selector valve 2 through the control valve 4 that is displaced between its two operative positions by means of the foot pedal valve actuator 3 which is held in one operative position under the bias of a spring 132. Fluid pressure is supplied to the control valve assembly 4 by a pump 5 which is driven by a motor 6. The fluid is pumped from a storage tank 7 to which the fluid is exhausted through return conduit 134. Pressure supply conduit 128 through which pressurized fluid is supplied from valve assembly 4 to the selector valve 2, is also connected to a pressure relief valve 136 by means of which the pressure developed in the piston cylinder 8 is limited. Excess pressure fluid is returned to the tank 7 by the return conduit 134 to which the relief valve 136 is connected with the valve assembly 4 including a pressure relief valve 138. Normally, the system operates so as to effect power displacement of the piston 120 under a pressure of 300 psi. As the tool assembly meets resistance, the pressure rises to a value of 2000 psi at which point the relief valves open resulting in automatic retraction of the piston to terminate the operating cycle. Of course, the cycle may be controlled through the foot pedal actuator 3 by means of which the supply and return of fluid is reversed. The selector valve 2 determines the direction in which the piston 120 is displaced during a power stroke and is thereby operative to select the metal working operation to be performed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-purpose metal working machine, comprising a fixed frame having a common support bed on which at least two workpiece operations are performed and a post extending vertically above the bed, a tool operating arm, fulcrum means mounted by the post for pivotally supporting the tool operating arm above the support bed, at least two tool devices mounted by the frame and engageable by said arm on opposite sides of said fulcrum means for alternately performing said operations on workpieces at spaced work stations on the bed, a single fluid piston device connected to the tool operating arm for imparting movement thereto through a predetermined stroke, means mounted on said support bed for anchoring the workpieces at the work stations corresponding to opposite limits of said stroke of the tool operating arm, a source of pressurized fluid, selector valve means operatively connected to the piston device for maintaining the tool operating arm at a selected one of said limits of the stroke, and tool actuating valve means connecting the source to the piston device for effective powered displacement of the tool operating arm through said stroke in a direction selected by the selector valve means, the machine including pressure relief means for limiting the force developed by the piston device approaching said limits of the stroke under said powered displacement.

2. The combination of claim 1 wherein said tool devices are punch and shearing mechanisms, respectively, the combination including a second tool operating arm pivotally mounted on said post, a third tool device engageable by said second arm, and link means interconnecting said piston device with both of said arms.

3. The combination of claim 1 wherein said pressure relief means comprises pressure relief valves whereby the operating cycle is terminated and occurrence of loud high pressure bypass noise is prevented.

4. A metal working machine, comprising a frame, a first tool operating arm, fulcrum means mounted by the frame for pivotally supporting the tool operating arm, at least two tool devices mounted by the frame and engageable by said first tool operating arm on opposite sides of said fulcrum means for alternately performing operations on workpieces at spaced work stations, a single piston device connected to the first tool operating arm for imparting movement thereto through a predetermined stroke, work anchoring means mounted on said frame for establishing said work stations at locations corresponding to the limits of said stroke at which the operations are performed on the workpieces, a source of pressurized fluid, selector valve means operatively connected to the piston device for maintaining the first tool operating arm at a selected one of said limits of the stroke, and tool actuating valve means connecting the source to the piston device for effecting powered displacement of the first tool operating arm through said stroke in a direction selected by the selector valve means, the machine including pressure relief means for limiting the force developed by the piston device approaching said limits of the stroke under said powered displacement.

5. The combination of claim 4 including a second tool operating arm pivotally mounted on said frame, a third tool device engageable by said second arm, and link means interconnecting said piston device with both of said arms.

6. The combination of claim 5 wherein said fulcrum means comprises a fulcrum post, a first fulcrum pin connecting said pin to said first tool operating arm, said second arm being connected by a second fulcrum pin to said post substantially directly below said first fulcrum pin.

7. The combination of claim 6 wherein said piston device comprises a cylinder from which a piston rod extends, and said link means comprise a bar pivotably connected to said first tool operating arm and pivotably connected to said second tool operating arm, said piston rod being pivotably connected to said second tool operating arm substantially collinearly with said bar.

8. The combination of claim 7 wherein said workpiece operations include at least one punching operation performed by a punch tool assembly comprising the first of said tool devices, a second of said workpiece operations including a first shearing operation performed at a shearing station on said first tool operating arm, and a third of said workpiece operations including a second shearing operation performed at a work surface at said second tool operating arm, said punch tool assembly comprising a tubular housing welded to a pair of forward extensions of said post, said housing being thereby vertically positioned in axial alignment with the shearing station, a punch plunger slidably extending through the housing and projecting thereabove for engagement with said first tool operating arm to which the punch plunger is connected by punch linking means.

9. The combination of claim 8 wherein said shearing station includes a shear plunger engaged with the underside of said first tool operating arm on the side of said first fulcrum pin opposite said punch plunger, said shear plunger being slidably displaceable through a blade guide to project a blade element between a pair of angle support cradles, said blade guide being held assembled between upper cross bars bridging a pair of end blocks by fastening means, which also secure the ends blocks to the cradles, the cradles being secured to a pair of base plates secured to the top of a saddle by means of which said shearing station is positioned on a support bed forming part of said work anchoring means, a spacer block separating said shearing station from said fulcrum post.

10. The combination of claim 9 wherein said second shearing operation is performed on a workpiece extending under said second tool operating arm and held anchored to the work surface by a hold-down device comprising a movable bar vertically positionable by adjustment means, the bar having a notch to enable positioning of rods therebelow, the workpiece being anchored to the work surface for shearing by a pair of blade elements secured by securing means to said second tool operating means and said work surface, respectively.

* * * * *